US007530307B2

(12) United States Patent
Lundin et al.

(10) Patent No.: US 7,530,307 B2
(45) Date of Patent: May 12, 2009

(54) CLEANING SYSTEM FOR CYLINDER SURFACES OF A PRINTING MACHINE

(75) Inventors: Kjell Lundin, Zwingenberg (DE); Thomas Riedl, Mannheim (DE)

(73) Assignee: Baldwin Oxy-Dry GmbH, Egelsbach (DE)

( * ) Notice: Subject to any disclaimer, the term of this patent is extended or adjusted under 35 U.S.C. 154(b) by 352 days.

(21) Appl. No.: 11/409,664

(22) Filed: Apr. 24, 2006

(65) Prior Publication Data

US 2006/0288894 A1 Dec. 28, 2006

(30) Foreign Application Priority Data

May 2, 2005 (EP) ..... 05009570

(51) Int. Cl.
*B41F 35/00* (2006.01)

(52) U.S. Cl. ..... 101/425; 101/424

(58) Field of Classification Search ..... 101/425.424
See application file for complete search history.

(56) References Cited

U.S. PATENT DOCUMENTS 3,913,797 A * 10/1975 Brym ..... 222/253
4,419,880 A * 12/1983 Hanowich ..... 73/1.22
4,686,902 A * 8/1987 Allain et al. ..... 101/424
5,005,478 A * 4/1991 Goldberg et al. ..... 101/425
5,330,576 A * 7/1994 Clauditz ..... 118/688
5,388,965 A * 2/1995 Fehn ..... 417/63
5,799,543 A * 9/1998 Nagai et al. ..... 74/490.09
6,010,032 A * 1/2000 Vermylen et al. ..... 222/1
6,386,106 B1 * 5/2002 Stanka ..... 101/425
2002/0185028 A1 * 12/2002 Stanka ..... 101/425

FOREIGN PATENT DOCUMENTS

| | | |
|---|---|---|
| EP | 0 570 763 | 11/1993 |
| EP | 0 627 268 | 12/1994 |
| EP | 0 765 747 | 4/1997 |
| EP | 0 916 492 | 5/1999 |
| EP | 1106355 | 6/2001 |
| FR | 2 539 868 | 7/1984 |
| WO | WO 89/01412 | 2/1989 |

* cited by examiner

*Primary Examiner*—Anthony H. Nguyen
(74) *Attorney, Agent, or Firm*—Volpe and Koenig, P.C.

(57) ABSTRACT

A cleaning system for cylinder surfaces of a printing machine, having a number of automated cleaning devices 1, 1', 1" allocated to a one or more cylinders, each having a supply line 4, 4', 4" for the supply of detergent 3, as well as a common feed pipe 5 for the supply lines 4, with at least one supply device being allocated to the feed pipe 5. The supply device includes a piston—cylinder unit 9 and the piston cylinder unit 9 and a detection unit 17, 18, 19 for controlling the piston stroke is provided.

8 Claims, 1 Drawing Sheet

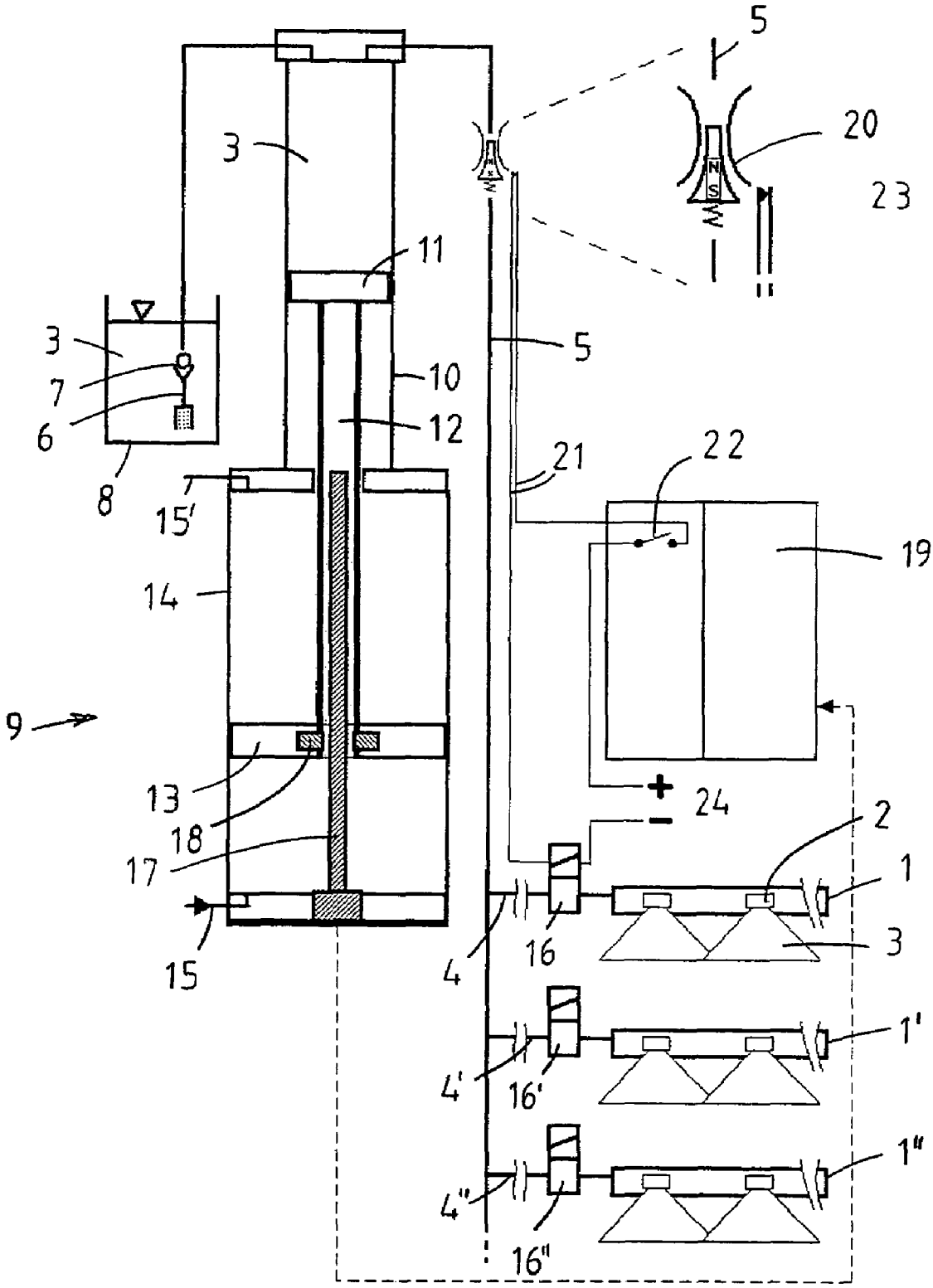
5
20
23
3
11
3
7
6
8
10
12
5
21
22
15'
19
14
9
13
18
17
24
2
1
15
4
16
3
1'
4'
16'
1"
4"
16"

CLEANING SYSTEM FOR CYLINDER SURFACES OF A PRINTING MACHINE

BACKGROUND

The invention relates to a cleaning system for cylinder surfaces of a printing machine. Accordingly, the present cleaning system comprises a number of automated cleaning devices are each allocated to one or more cylinders. The cleaning devices are each provided with a supply line for feeding a detergent. The supply lines receive the detergents from a common feed pipe, with at least one pump being allocated to the feeding device, in general.

Printing machines, and here in particular newspaper rotary printing machines, high-speed jobbing machines, and sheet-fed letterpress printing machines of all types of printing methods, such as offset printing, anilox printing, intaglio printing, flexo printing, anilox-flex high and low printing are addressed. All drums, rollers, and cylinders of a printing machine are included under "cylinders", whose surfaces are to be cleaned, in particular rubber blanket cylinders, grounding-in cylinders, plate and form cylinders, cooling cylinders, guiding rollers, as well as color cylinders.

All printing machines mentioned have in common that for guidance, processing, and drive of sheets or webs to be printed an intense contact is required between the material to be printed and the cylinders. Here, residue of paper dust (fibers, coat, fillers, etc.), ink, and perhaps powder dust develops, for example when paper is used as the material to be printed. This residue interferes with the functionality of the cylinder. For example, residue in rubber blankets in offset printing leads to the loss of dot sharpness in the print and some printing sections do not print correctly. For maintaining printing quality as well as operational safety, it is mandatory that the above-mentioned cylinders are regularly cleared of contaminants.

This generally occurs via automatic cleaning devices, which apply detergents onto the cylinder surfaces to be cleaned and use brushes or cloth, if necessary, in order to lift the contaminants partially dissolved by the detergent off the cylinder surface. An example for one such cleaning device is described in EP 1 106 355 A1.

In high-speed jobbing machines ink is used, which needs to be dehydrated after printing, so that the respective printing machines are provided with a dryer, through which the printed material is guided after the printing process. The dehydration occurs at elevated temperatures, so that safety aspects come to the fore: the ink contains evaporating hydrocarbon—components, which can reach a flammable concentration in the dryer under unfavorable conditions. Accordingly, the heat influence in the dryer as well as the production speed, which is influential on the time the printed material remains between the printing process and the drying process, is to be adjusted such that the concentration of hydrocarbons in the dryer always remains below a limit, i.e. below 25% of the lower explosion limit.

In order to avoid considerable production stops the regularly necessary cleaning of the cylinder surface of the printing machine must be performed under production conditions when printing paper webs, i.e. the cylinders to be cleaned are in contact with the paper web during the cleaning process. Therefore, during the cleaning process the paper web transports detergent into the dryer. However, the commonly used detergents have a relatively high portion of evaporating hydrocarbons, so that here too it must be ensured that the concentration of hydrocarbons in the dryer does not become too high. Therefore, too much detergent must not be used in the cleaning process.

In particular in web offset printing machines for high-speed jobbing material of a high value is used. From 10 to 30 spoiled copies per second develop during the cleaning process at production speed. Therefore, for reasons of cost, the cleaning process is to be kept as short as possible. However, that requires that relatively large amount of detergent must be used, because the effective time, in which the detergent dissolves the contaminants, is very limited.

Therefore, there are two contradicting objectives: on the one hand, the amount of detergent used for cleaning is to be kept as small as possible, because otherwise too much hydrocarbon—containing detergent enters the dryer and causes the risk of the concentration of hydrocarbons becoming too high. On the other hand, the time for the cleaning process shall be kept as short as possible. Therefore, the use of the detergent is to be optimized such that a cleaning effect is achieved as good as possible, with a duration of the cleaning process being kept as short as possible with the use of as little detergent as possible.

Controlling the application of the detergent during the cleaning process is more expensive by such an optimization. The more it is mandatory to ensure a trouble free and absolutely reliable control of the amount of detergent used, in order to prevent that accidentally too much detergent is carried along by the printed material web into the dryer and an excessively high hydrocarbon concentration develops, here.

SUMMARY

The present invention is therefore based on the objective of improving a cleaning system for cylinder surfaces of a printing machine of the type mentioned at the outset such that the amount of detergent applied during the cleaning process can be controlled reliably and trouble free.

This objective is attained in a cleaning device having the features of the invention. Advantageous embodiments and further developments of the cleaning system according to the invention are described in detail below.

According to the present invention a piston-cylinder unit is used as the feeding device, which feeds the detergent into the feed pipe and the supply lines of the automated cleaning devices, with its piston stroke being controlled by a detection device. According to the invention here the fact is used, that the overall amount of detergent carried along by the printed material into the dryer in a temporal interval is smaller in any case than the total amount of the detergent fed to the cleaning system via its cleaning devices during said time interval. In order to ensure that a certain concentration in hydrocarbons is not exceeded in the dryer, it is therefore sufficient to control the feeding of detergent to the cleaning system and to prevent it from exceeding a certain limit. Then, the limit itself depends on the conditions on site, for example the number of cleaning devices and their location, as well as how the speed of the printing machine during the cleaning process, and certainly also on the maximum concentration of hydrocarbons permitted in the respective dryer.

However, the present invention not only uses this principle but also renders its use trouble free by using a piston—cylinder unit as the feeding device and/or pump and by not directly measuring, for example, the throughput of the detergent but a stroke control of the piston of the piston—cylinder unit. This stroke control offers the important advantage that it is unaffected by potential variations in the viscosity of the detergent, in contrast to an optical throughput measuring device, for example, and that any air potentially mixed in can at best falsify the result of the measuring such that the a throughput is too great. This is acceptable with regard to the safety requirements.

Additionally, a stroke control of the piston is particularly easy to be embodied, for example via a path measuring device, which is allocated at the piston rod. In reference to other pumps, in a piston—cylinder unit there is a very precise connection between the detergent fed and the path of the piston. The detection device can be embodied such that a path measuring device is arranged at the piston—cylinder unit, with its signals being forwarded to the control of the cleaning system. This way the control of the cleaning system becomes a component of the detection device according to the invention, because it processes the signals received from the stroke measuring device and sends them for further processing to the control switch itself. The calculations required therefore can be performed by a software module, which is integrated in the control of the cleaning system.

Of course, it is also possible and included in the scope of the invention, to use more than one piston—cylinder unit, which provides the feed pipe with detergent. Then, only the measured stroke path(s) of the piston must be added, if necessary after a conversion. Accordingly it is possible to provide a printing machine with more than one cleaning system according to the invention, which is controlled by a single central control.

In order to increase security, a flow rate—measuring switch can be mounted at the feed pipe downstream of the piston—cylinder unit; however, due to its higher sensitivity against malfunctions, a higher value of flow rate limit should be set, so that the flow rate measuring switch is only provided as an emergency switch for an increased level of safety in a single fault safety system. For this purpose, when the limit of the flow rate is reached the function of the cleaning system can be interrupted, for example by severing the power to the control and the valves.

Within the scope of the invention, particular advantages result when the feed pipes and/or the cleaning device are provided with switchable check valves. This allows greater precision in the use of detergent over time, namely by a pulsed opening and closing of the switchable check valves. By this pulsed process the amount of detergent applied in a certain temporal interval can be distributed very evenly over time largely independent from the opening cross-section and a perhaps uneven pressure distribution in the cleaning device. By varying the pulse frequency a varied amount of detergent is applied. This further development of the invention also allows an optimum use of detergent in the sense of the objective.

This technology can be used particularly effectively when it is ensured that essentially the same pressure is applied at the switchable check valves at all times, so that the detergent in the cleaning system is also pressurized during the application of the detergent. The feeding device then primarily comprises a pump for maintaining the pressure, and the object of feeding the detergent into the system is only secondary. Maintaining the pressure in the supply line can occur via a pressure tank, allocated to the supply lines, or the supply lines themselves can be embodied as pressure storage by being embodied elastically and their volume being elastically diminishing during a pulse when detergent is released.

Mounting the switchable check valves immediately adjacent to the cleaning device additionally allows much shorter pulses and much higher pulse frequencies than a supply device operated in a pulsed manner. Shorter pulses and higher frequencies can achieve that at the beginning of the pulse more detergent than necessary at that very time is applied onto the respective parts of the cleaning device, while at the end of the pulse perhaps insufficient amounts of detergent are applied, though.

In an advantageous further development of the invention the detection device calculates the average speed of the piston motion in a certain temporal interval using the detected measuring values of the piston stroke, which advantageously depend on the length of the pulses and the pulse frequency as well as the duration of the cleaning cycle, and compare it to a predetermined upper limit, due to the fact that the average speed of the piston motion is proportionally connected to the amount of detergent fed into the system. When the upper limit for the average speed of the piston—cylinder motion has been reached or even exceeded, this means that a certain amount of detergent has been fed into the system during a certain temporal interval and thus the same amount of detergent has been processed in the cleaning device. In the worst case the entire amount of detergent was transported into the dryer via the printed material. The result of the comparison of the average speed of the piston stroke and the predetermined upper limit is then further processed in the control of the cleaning system in order to trigger, if necessary, a safety switch-off or an automatic reduction of the detergent application.

Due to the fact that the maximum amount of detergent, that may be processed by the cleaning devices during the cleaning process in a certain temporal interval during production, depends on the production speed of the printing machine at any given time, in order to prevent any excessively high concentration of hydrocarbons in the dryer, it is advantageous for the detection device to set the predetermined upper limit for the average speed of the piston stroke depending on the average production speed of the printing machine in the respective temporal interval. However, this may also be done manually.

BRIEF DESCRIPTION OF THE DRAWINGS

Using the attached drawing, an exemplary embodiment of the cleaning system according to the invention is described and explained in greater detail.

The single FIGURE shows schematically the structure of the exemplary embodiment for a cleaning system according to the invention. For reasons of a clear illustration of the inventive principle, the printing machine and/or the cylinders of the printing machine to be cleaned are not shown.

DETAILED DESCRIPTION OF THE PREFERRED EMBODIMENTS

The cleaning system shown schematically comprises three cleaning devices 1, 1', 1" with jets 2 for applying detergents 3 onto the cylinders to be cleaned respectively, one supply line 4, 4', 4" each allocated to the cleaning devices 1, 1', 1" and one common feed pipe 5 for the supply line 4, 4', 4". In the feed pipe 5, which ends at a suction lance 6 with a return valve 7 in a tank 8 for the detergent 3, a piston—cylinder unit 9 is provided as the pump for applying pressure to the feed pipe 5 and in cooperation with the return valve 7, for feeding detergent 3 into the feed pipe 5. The piston—cylinder unit 9 comprises a hydraulic side 10, at which a first piston 11 pressurizes the detergent 3. A piston rod 12 connects the first piston 11 at the hydraulic side 10 to a second piston 13 at a pneumonic side 14. The pneumatic side 14 of the piston—cylinder unit 9 is embodied as a dually-effective pneumatic cylinder and operates via feed pipes 15, 15' via pressurized air.

In the feed pipes 4, 4', 4", switchable check valves 16, 16', 16" are provided, in order to allow detergent 3 to be supplied from the supply line 4 to the jets 2 of the cleaning devices 1. The check valves 16 are allocated immediately adjacent to the jets 2 of the cleaning devices 1 and are opened and closed very rapidly, in order to create a pulsed operation of the jets 2. The supply lines 4, which are relatively long, as indicated, operate as pressure storage based on their inert elasticity, so that the pressure created by the first piston 11 in the feed pipe 5 is maintained during the opening time of the check valve 16 and an almost constant motion of the first piston 11 occurs and thus also the second piston 13 for maintaining the pressure in the feed pipe 5.

The piston rod 12 of the piston—cylinder unit 9 extends along a stator 17 of a stroke measuring device, its movable part 18 being arranged in the second piston 13. Therefore, this stroke measuring device 17, 18 measures the motion of the first piston 11 and/or its distance traveled, with it being allocated at the pneumatic side 14 of the piston—cylinder unit 9 and thus having no contact to the detergent 3. The detergent 3 can therefore not falsify the respective measurement.

A dot-dash line indicates that the stroke measuring device 17, 18 is connected to a control 19 of the cleaning system and acts upon it in the manner according to the invention. Together with parts of the control 19 the stroke measuring device 17, 18 forms the detection device in the sense of the present invention, which for example influences the pulse times and the pulse frequency of the check valves 16.

The check valves 16, 16', 16" are switched via a control exit 22, which is allocated to a voltage source 24, even if, for purposes of a better illustration, respective connection pipes are shown for the first check valve 16 only. In the feed pipe 5, a flow rate measuring switch 20 is arranged as an additional safety device with a single fault safety, which is shown in an enlarged representation for better illustration. The contact 23 in this flow rate measurement switch 20 is a reed switch, switching the check valves 16, 16', 16" powerless, as indicated by the power lines 21, as soon as the flow of detergents 3 through the flow rate measurement switch 20 exceeds a preset volume flow limit. The cleaning system shown is then switched off and no more detergent 3 exits the jets 2. However, the volume flow measuring switch 20 merely represents a subsidiary safety device and thus a redundant system, because the stroke measuring of the piston stroke of the piston—cylinder unit 9 according to the invention already offers the required safety via the stroke measurement device 17, 18.

The invention claimed is:

1. A cleaning system for cylinder surfaces of a printing machine, comprising a number of automated cleaning devices (1, 1', 1") each allocated to one or more cylinders, each having a supply line (4, 4', 4") for supplying detergent (3), a common feed pipe (5) connected to the supply lines (4), at least one supply device allocated to the common feed pipe (5), the at least one supply device comprises a piston-cylinder unit (9), and a detection unit (17, 18, 19) is allocated to the piston-cylinder unit (9) for controlling the piston stroke of the piston, wherein the detection unit (17, 18, 19) is adapted to calculate an average speed of piston motion in a certain temporal interval using detected measuring values of the piston stroke and compares the average speed to a predetermined upper limit for the average speed as well as provides results of the comparison for further processing.

2. A cleaning system according to claim 1, wherein the detection device (17, 18, 19) includes a stroke measuring device (17, 18) allocated to a piston rod (12) of the piston-cylinder unit.

3. A cleaning system according to claim 1, wherein a flow rate measuring switch (20) is mounted at the feed pipe (5) downstream of the supply device (5).

4. A cleaning system according to claim 3, wherein the flow rate measuring switch (20) is embodied such that it compares a detected flow rate to a volume flow limit, and upon reaching or exceeding the volume flow limit, interrupts operation of the cleaning system.

5. A cleaning system according to claim 1, wherein the supply lines (4) and/or the cleaning devices (1) are provided with switchable check valves (16).

6. A cleaning system according to claim 5, further comprising a pressure storage tank (4), wherein the supply lines (4) are connected to the pressure storage tank.

7. A cleaning system according to claim 1, wherein the detection device (17, 18, 19) is adapted to determine the predetermined upper limit for the average speed depending on the average speed of the printing machine in the respective temporal interval.

8. A cleaning system according to claim 5, wherein the supply lines are elastic to store pressure.

* * * * *